US007213517B2

(12) United States Patent
Ronn et al.

(10) Patent No.: US 7,213,517 B2
(45) Date of Patent: May 8, 2007

(54) DEVICE FOR A PROXIMITY-FUZED UNIT AMMUNITION

(75) Inventors: Torsten Ronn, Karlskoga (SE); Nils Johansson, Karlskoga (SE)

(73) Assignee: Bofors Defence AB, Karlskoga (SE)

( * ) Notice: Subject to any disclaimer, the term of this patent is extended or adjusted under 35 U.S.C. 154(b) by 0 days.

(21) Appl. No.: 10/312,947

(22) PCT Filed: Jun. 20, 2001

(86) PCT No.: PCT/SE01/01407

§ 371 (c)(1),
(2), (4) Date: Jul. 28, 2003

(87) PCT Pub. No.: WO02/03020

PCT Pub. Date: Jan. 10, 2002

(65) Prior Publication Data

US 2004/0237825 A1 Dec. 2, 2004

(30) Foreign Application Priority Data

Jul. 3, 2000 (SE) ..... 0002482

(51) Int. Cl.
*F42C 13/00* (2006.01)

(52) U.S. Cl. ..... 102/211; 102/221; 102/229

(58) Field of Classification Search ..... 102/211–214, 102/221, 229

See application file for complete search history.

(56) References Cited

U.S. PATENT DOCUMENTS 3,793,958 A * 2/1974 Holt et al. ..... 102/213
3,978,797 A 9/1976 Harrington et al.
4,015,530 A * 4/1977 Dick ..... 102/213
4,098,191 A 7/1978 Bagwell et al.
4,185,559 A * 1/1980 Little ..... 102/211
4,936,216 A * 6/1990 Skagerlund ..... 102/213
4,951,901 A * 8/1990 Dunne ..... 244/3.23
5,277,114 A 1/1994 Witt
5,693,906 A * 12/1997 Van Sloun ..... 102/251

FOREIGN PATENT DOCUMENTS

GB 2133514 A 7/1984

* cited by examiner

*Primary Examiner*—Michelle Clement
(74) *Attorney, Agent, or Firm*—Connolly Bove Lodge & Hutz LLP

(57) ABSTRACT

A proximity-fuzed ammunition unit (1) that can approach a target and where during approach the proximity fuze function effects or gives rise to a voltage pulse pattern that is dependent on objects located along the flight path of the ammunition unit on its approach to the target. The voltage pulse pattern forms the basis for the actution of at least one triggering device (18) incorporated in the ammunition unit. The electrical circuit or circuits incorporated in or interacting with each triggering device is/are arranged to sense a voltage or amplitude value in the trailing edge of a pulse incorporated in or forming the pattern. If the pattern comprises a number of pulses an indication is given when a predetermined number of pulses has appeared to appears. Each electrical circuit causes or effects the opeation of the triggering device for its actuation depending on the said sensing and/or indication.

3 Claims, 3 Drawing Sheets

DEVICE FOR A PROXIMITY-FUZED UNIT AMMUNITION

Figure 1:
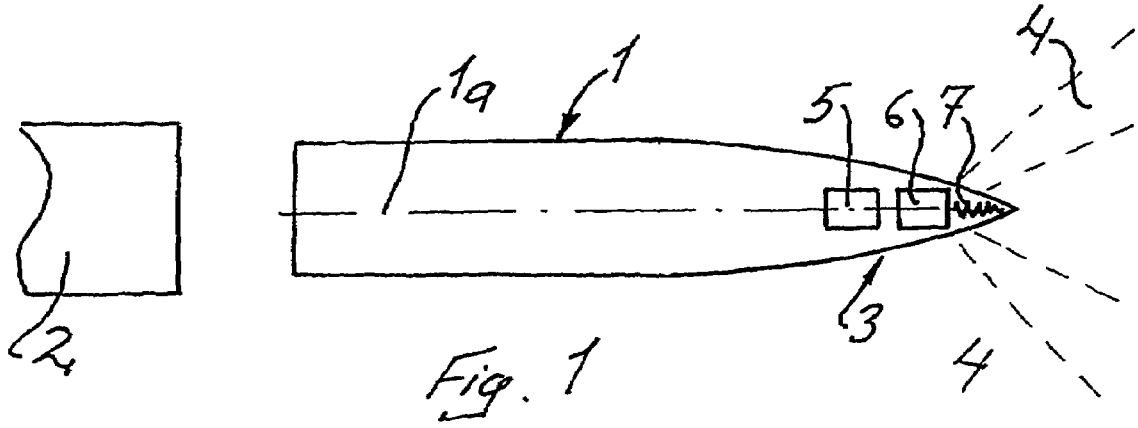

The present invention relates to a device for a proximity-fuzed unit of ammunition that can fly towards a target and during the approach to the target the proximity fuze function effects or causes a voltage pulse pattern that is dependent on objects such as a buildings, trees, main battle tanks, etc that are adjacent to the flight path of the ammunition unit on its way to the target. The voltage pulse pattern forms the basis for the actuation of at least one triggering device incorporated in the ammunition unit.

The engagement of different types of target by proximity-fuzed ammunition units that are launchable by using, for example, a manportable or deployable launcher weapon is already known. The proximity fuze means that the target can be detected along the forwards directed flight path of the ammunition unit, and that burst or actuation of the ammunition unit can be effected at the least in close proximity to the target.

There is a need, however, to be able to avoid undesired actuation of the ammunition unit. Such actuation can arise because an object of a different type can be near the flight path of the ammunition unit on its way to the target. This problem can be resolved by the use of timing circuits that prevent actuation of the ammunition unit during a specific initial part of its flight path so that, for example, when launching from a launch pad or equivalent the undesired actuation of the ammunition unit near the launch site is prevented. Even such an arrangement can give rise to shortcomings in the precision that is often desired during the bombardment or engagement in question.

There is thus a desire to achieve more precision in an engagement, i.e. attain a burst adjacent to or in targets in question in the various engagement situations, despite the fact that the environment may include objects that can actuate the triggering functions. Reference can hereby be made to close combat in urban areas where, for example, it is desired to achieve a burst in a building, block or street corner behind, etc, that is further away than the intermediate buildings, streets, corners, etc in relation to the deployment position. The objective of the present invention is to resolve this problem among other things.

As claimed in the present invention a certain programming function shall exist, and it is vital that this programming function can be made effective so that its operation, servicing, etc can meet the requirements for technical simplicity and safety that are associated with weapon-fired ammunition in general and with ammunition units of this category in particular. There is even a requirement for rapid re-programming functions. The present invention is envisaged to resolve these problems too.

The main characteristic features for a device of the type initially mentioned are considered to be, among other things, that each triggering device incorporated or the electrical circuit or circuits interacting with each triggering device is/are arranged to sense a voltage or amplitude value adjacent to a trailing edge of a pulse incorporated in the pattern or of a pattern forming pulse. The present invention is also characterised by the fact that it is possible to predetermine the number of pulses that shall exist in the pattern. Depending on the number of pulses selected, each electrical circuit thereby causes or effects the actuation of the triggering devices involved.

The preferred embodiments of the present invention mean that in the case with the triggering function calculated on the basis of the number of pulses, the electrical circuit or circuits is/are arranged to effect or cause triggering/actuation/burst of the ammunition unit either at the leading edge or trailing edge of the last pulse in the predetermined number of pulses in the pulse pattern. In the case with the triggering function calculated on the basis of the number of pulses the electrical circuit or circuits can alternatively be arranged to effect or cause triggering/actuation/burst of the ammunition unit after a specific predetermined duration after the first edge occurs in the last pulse. A first electrical circuit in one embodiment can be arranged to effect a sense signal in the sensor when the voltage amplitude falls from a maximum value to a predetermined lower value that can be integral, or to which it can be programmed, in the circuit concerned. In the case utilising counting of a predetermined number of pulses, the number of pulses can be set via a programming device on the proximity fuze or ammunition unit. The programming device can thereby consist of a rotary switch in the front parts of the ammunition unit. Setting or programming can also be actuated electrically or optically.

The ammunition unit thereby becomes beneficial to use in various contexts, such as in the case where the ammunition unit in question is assigned a flight path extending along two or more blocks or collections of buildings in a built-up area (town, village, etc) with houses and/or buildings with intervening open spaces consisting of streets, alleys, etc. The houses or buildings in question thereby cause the said pulses in the pattern, and the intervening spaces cause the pulse intervals with low voltage values in the pattern. Engagements in other situations can also be effectively accomplished. Reference is hereby made to the subsequent patent claims and the examples disclosed in the description.

The above proposals enable a number of advantages. The ammunition unit does not need to be basically re-configured since already well known, proven components can be used which enables the prerequisites for use from the financial aspect, among other things. The ammunition unit can be rapidly re-programmed for different firing or engagement situations, and the ammunition units can exhibit conventional external designs and thus do not need to be extra equipped.

Figure 2:
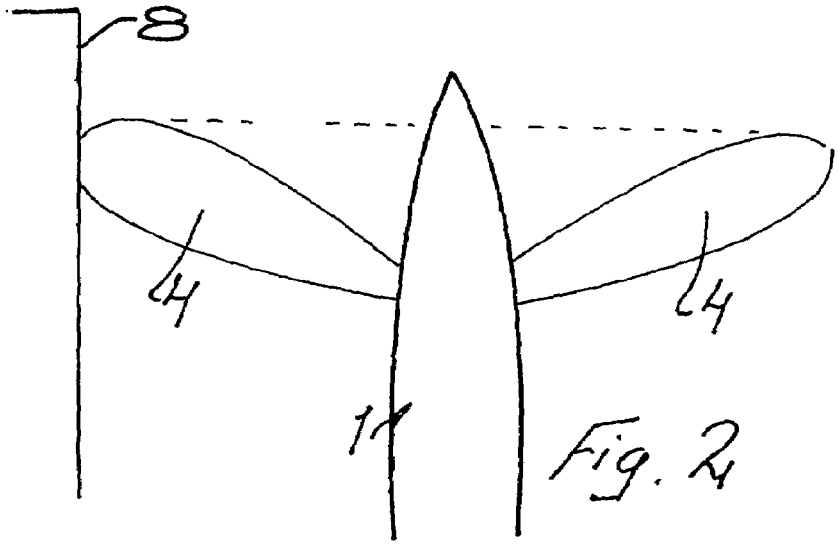
Figure 3:
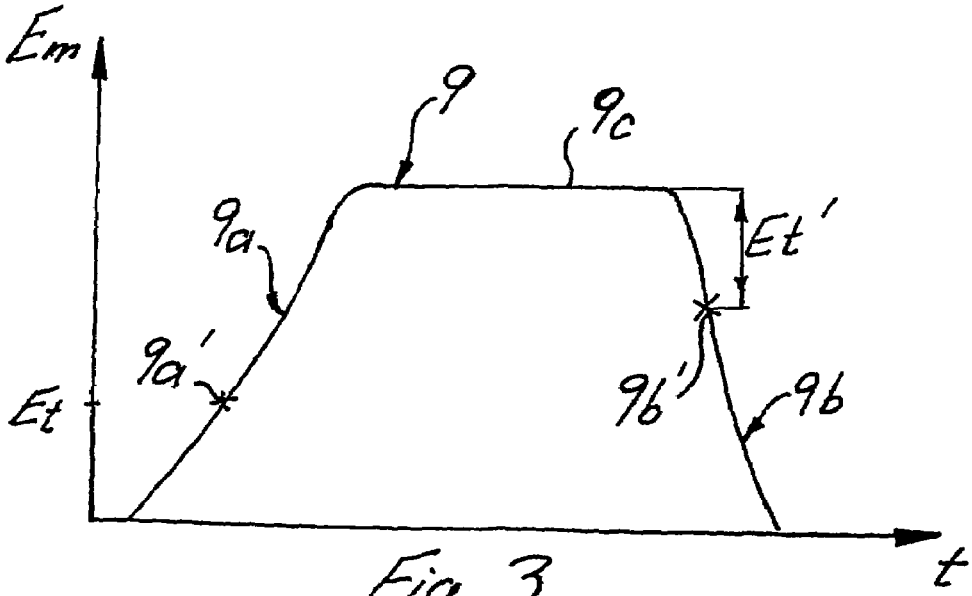
Figure 4:
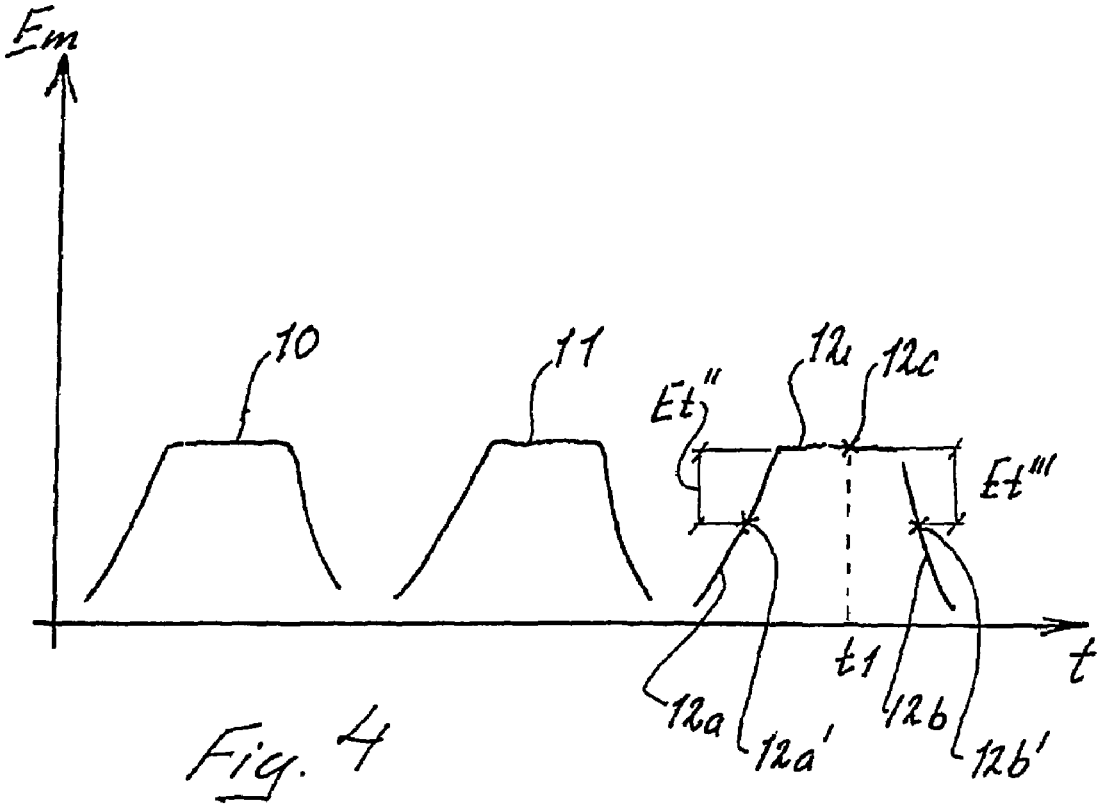
Figure 5:
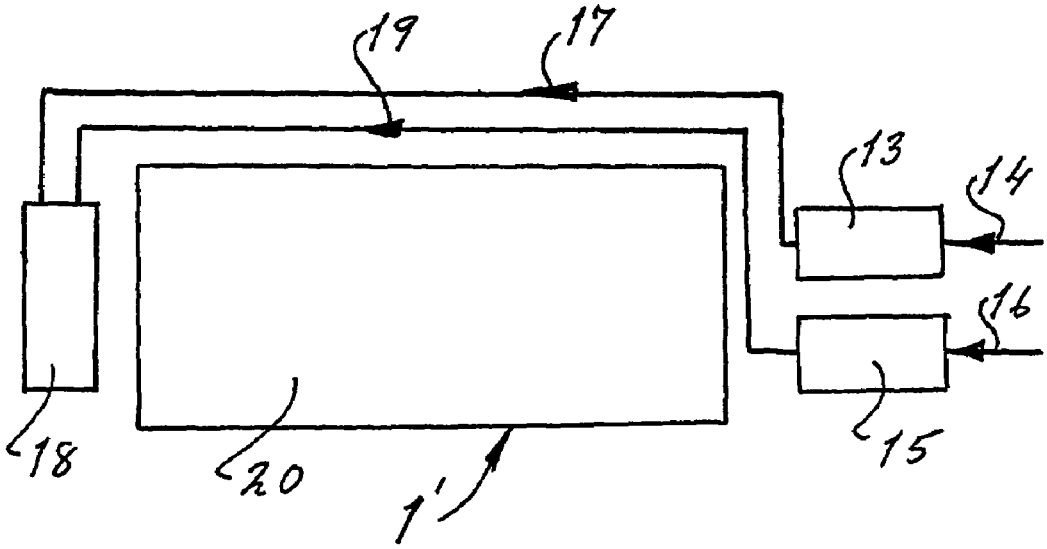
Figure 6:
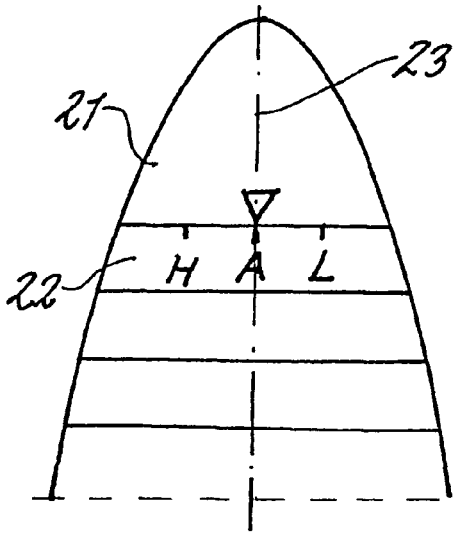
Figure 7:
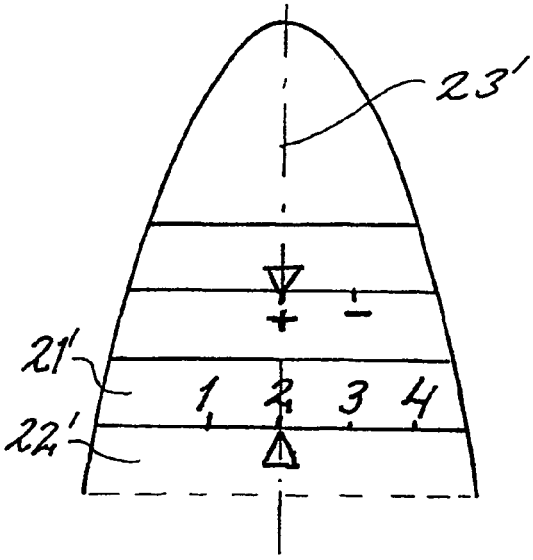
Figure 8:
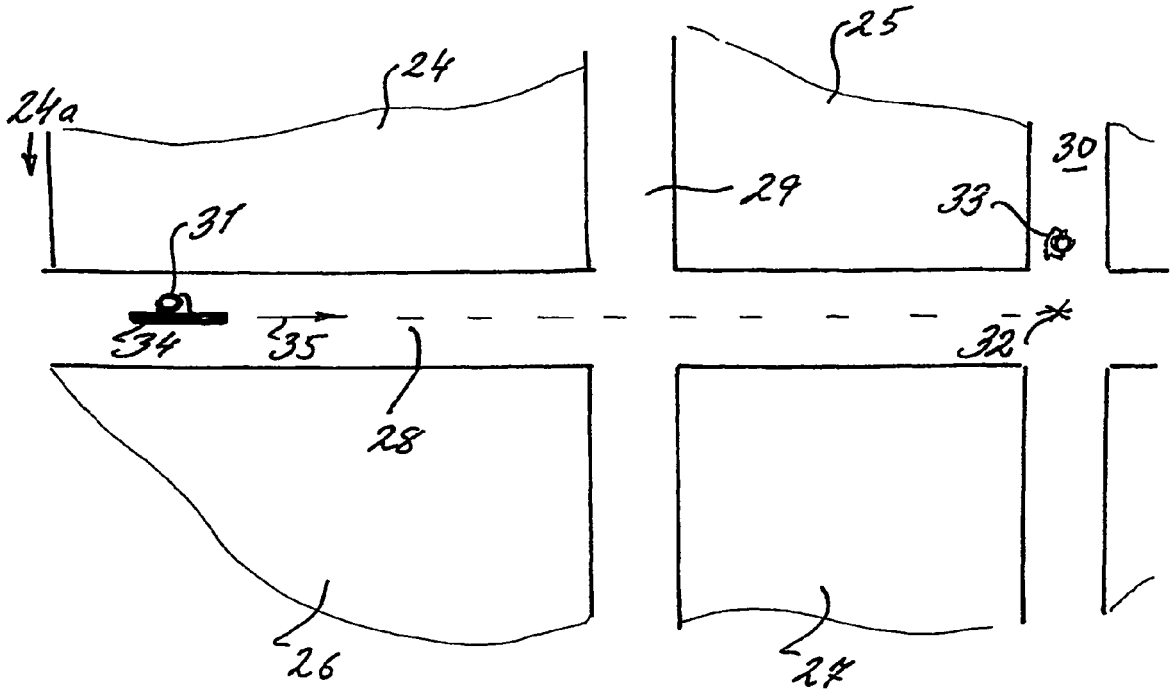

A currently proposed embodiment of a device displaying characteristics that are significant for the present invention is described below with reference to the appended FIGS. 1–8 in which FIG. 1 shows a lateral view and partial section of a proximity-fuzed ammunition unit comprising, among other things, an arming device, antenna and electronics, while FIG. 2 shows a lateral general view of the ammunition unit illustrated in FIG. 1 in the proximity of an object in its flight path, such as a wall of a building, FIG. 3 shows a first graphical representation of a voltage pulse pattern that in principle comprises a pulse that occurs when the proximity fuze senses a nearby object in conjunction with the engagement of a target, FIG. 4 shows a graphical representation of a case where the voltage pulse pattern comprises a number of pulses FIG. 5 shows a lateral general view of the electrical circuits incorporated in the ammunition unit as well as the triggering or detonating device, FIG. 6 shows a lateral general view of the first programming device, while FIG. 7 shows a lateral general view of the second programming device, and FIG. 8 shows a horizontal view of an engagement situation in a built-up area with blocks, streets, etc.

Number 1 in FIG. 1 denotes an ammunition unit that can be launched from a manportable launch tube 2 of already known type. The ammunition unit can be of spin-stabilised or non spin-stabilised type. The front parts 3 of the ammunition unit exhibit a proximity fuze, the forwards directed sensing cones or lobes of which are symbolised by 4. The proximity fuze or ammunition unit comprises an arming device 5, electronics (electrical circuits) 6, and an antenna device 7 to perform the sensing function 4. Since the ammunition unit and proximity fuze as such are of already well known type they are not described in any further detail herein; instead, reference is made to generally known designs and techniques. The longitudinal axis of the ammunition unit is designated 1*a* in FIG. 1.

In the Figures the sensing lobes are designated 4, 4' and the ammunition unit 1 in question is approaching a target, and in the flight path of the said ammunition unit there is an object, e.g. in the form of a house wall 8, in the vicinity of which the target can be located (see FIG. 2).

In accordance with the proximity fuze function a voltage pulse pattern is generated via the sensing of sensing lobes 4, 4'. The voltage pulse pattern in question can, in accordance with FIG. 3, comprise a pulse designated 9. In FIG. 3 the vertical axis is assigned the voltage or amplitude E and the horizontal axis t. In accordance with already known techniques it was earlier proposed that the triggering function be effected with the aid of the leading edge 9*a* of pulse 9 and that, for example, triggering of ammunition unit 1 (see FIG. 1) shall occur at a value Et, i.e. at point 9*a*', to actuate the explosive charges or compositions. In accordance with the above a triggering function using the leading edge of pulse 9 will not be exact if pulse 9 is initiated by an object in the vicinity of the true target that is to be engaged. As claimed in the present invention triggering shall instead be effected with the aid of the trailing edge 9*b* of the pulse, e.g. at a value 9*b*' on voltage E. The voltage amplitude shall thus fall from the maximum value of the pulse (that can constitute a flat sector in the pulse as illustrated in FIG. 3) to the said value 9*b*'. The maximum value is designated 9*c* in FIG. 3. The magnitude of the value between values 9*c* and 9*b* is designated Et" in FIG. 3, and can essentially be equivalent to the said value Et. With this arrangement the ammunition unit can thus pass the object in question that gives rise to the pulse in question, while enabling the proximity fuze function and the ammunition unit to pass by and burst behind the house wall or equivalent in question.

In FIG. 4 the pulse pattern in question comprises three different pulses 10, 11, 12 generated by objects that were or are located along the flight path of the ammunition unit on its approach to the target. As claimed in the concept of the present invention, triggering or actuation of the ammunition unit shall occur only after a predetermined number of pulses has been identified in the pattern. In the present case or example triggering or actuation shall occur with the third pulse 12, i.e. no actuation for any of the pulses 10 and 11. In this case actuation occurs from the leading edge 12*a* or trailing edge 12*b*, depending on the actual engagement situation. When the third pulse occurs time circuits can also be used so that actuation is effected at point 12*c* at point in time t1, which point 12*c* is located on the horizontal sector in question of pulse 12. Voltage values Et' and Et" can in principle be of equal magnitude. Actuation at point 12*a*' is in the voltage rise while actuation at point 12*b*' is in the voltage drop from the maximum value, compared with the above.

In accordance with the above it shall be possible to use electrical time circuits to sense the voltage values in question of the leading or trailing edge of each pulse. In this case a first electrical circuit is used as illustrated in FIG. 5 where the circuit is designated 13. This circuit can be pre-programmed for specific voltage values or can be set for specific voltage values via a setting function 14. In the case where one wishes to utilise counting of a predetermined number of pulses (cf. the case illustrated in FIG. 4) a second electrical circuit 15 is employed that is programmable for the actual number of pulses via a control 16. When the first electrical circuit has identified or detected a voltage at which triggering of the ammunition unit 1' shall occur, the said circuit emits a control signal 17 to the triggering device 18 of the ammunition unit. In the case that the arrangement operates by the number of pulses, the second electrical circuit emits a control signal 19 to the triggering circuits 18 when the programmed number of pulses has been counted. The said actuations 17 and 19 cause the triggering device 18 to actuate the explosive charge 20, which thereby detonates.

FIG. 6 shows an example of how the programming device can be arranged with reference to the above. The programming device can thereby comprise a part 21 that is rotatable about the longitudinal axis 23 of the ammunition unit in relation to part 22. This arrangement enables, for example, voltages Et' and Et" to be programmed for different values, which means that actuation of the ammunition unit can occur at different distances behind an object in its flight path that initiates the voltage pulse in question (cf. item 9 in FIG. 3), and that the minimum level for the said object can be governed.

FIG. 7 shows another example of programmability via a programming device. Part 21' is thereby rotatable about the longitudinal axis 23' in relation to part 22'. The various rotational programming positions indicate the number of pulses etc, and whether triggering shall be effected on the positive or negative edge of the pulse in question.

FIG. 8 shows blocks or built-up areas designated 24, 25, 26 and 27 with existing streets and alleys, etc 28, 29 and 30 in between. The launch of an ammunition unit shall, for example, take place at a position 31 at the front end 24*a* of the building or block 24. Detonation or triggering of the ammunition unit shall occur at a position 32 close to a target 33 that may be concealed by a building or block such as block 25. The ammunition unit is symbolised by 34 and the direction of the flight path by 35. As claimed in the above the buildings or blocks can cause pulses (cf. pulses 10, 11, 12 in FIG. 4) along the flight path 35. The arrangement as claimed in the present invention enables burst/detonation in position 32 despite the fact that the buildings, blocks, etc in question cause indications in the proximity fuze function. From the above it is envisaged that despite the intervening buildings or objects a burst/detonation can be effected close to the target 33 in an effective manner. It is also envisaged that the said ammunition unit can be adapted to the number of buildings, blocks, streets, etc. For example, the case illustrated in FIG. 3 can be employed if only one building or house 24 exists etc. Other functions that are not described herein represent already known techniques.

The present invention is not limited to the design examples described above, but can be subjected to modifications within the framework of the subsequent Patent claims and the invention concept.

We claim:

1. A device for a proximity-fused ammunition unit comprising:

a proximity fuse function arranged to effect a voltage pulse that is dependent on an object located along a flight path of the ammunition unit to a target;

at least one triggering device incorporated in the ammunition unit and arranged to operate based on the voltage pulse; and an electrical circuit arranged to interact with the at least one triggering device, wherein the electrical circuit is arranged to sense an amplitude value of the voltage pulse in conjunction with a trailing edge of the voltage pulse, and wherein the electrical circuit is arranged to effect actuation of the at least one triggering device when the amplitude value falls a predetermined amount to a non-zero value from a maximum value, said predetermined amount being programmed into the at least one electrical circuit.

2. The device of claim 1, comprising a programming device arranged to set the predetermined amount.

3. The device of claim 2, wherein the programming device comprises a rotary setting device located in front parts of the ammunition unit.

* * * * *